US007964547B2

(12) United States Patent
Underwood et al.

(10) Patent No.: US 7,964,547 B2
(45) Date of Patent: Jun. 21, 2011

(54) CLEANER CONCENTRATE COMPRISING ETHANOLDIGLYCINE AND A TERTIARY SURFACTANT MIXTURE

(75) Inventors: Danielle E. Underwood, Winston-Salem, NC (US); Tami J. Tadrowski, Greensboro, NC (US); Karen O. Rigley, Greensboro, NC (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 12/902,595

(22) Filed: Oct. 12, 2010

(65) Prior Publication Data

US 2011/0028370 A1 Feb. 3, 2011

Related U.S. Application Data

(63) Continuation of application No. 12/105,822, filed on Apr. 18, 2008, now Pat. No. 7,838,484.

(51) Int. Cl.
*C11D 1/94* (2006.01)
*C11D 3/30* (2006.01)

(52) U.S. Cl. ..... 510/197; 510/225; 510/233; 510/235; 510/245; 510/252; 510/365; 510/421; 510/422; 510/426; 510/427; 510/490; 510/509; 510/511

(58) Field of Classification Search ..... 510/197, 510/225, 233, 235, 245, 252, 365, 421, 422, 510/426, 427, 490, 509, 511
See application file for complete search history.

(56) References Cited

U.S. PATENT DOCUMENTS

| | | | | |
|---|---|---|---|---|
| 4,676,920 | A * | 6/1987 | Culshaw | 510/396 |
| 5,254,290 | A * | 10/1993 | Blandiaux et al. | 510/417 |
| 5,670,473 | A * | 9/1997 | Scepanski | 510/445 |
| 5,858,941 | A * | 1/1999 | Oakes et al. | 510/179 |
| 7,341,987 | B2 * | 3/2008 | Wei et al. | 510/445 |
| 2003/0176305 | A1 * | 9/2003 | Hoyt et al. | 510/245 |
| 2004/0067866 | A1 * | 4/2004 | Griese et al. | 510/407 |
| 2004/0122112 | A1 * | 6/2004 | Griese et al. | 516/43 |
| 2005/0079992 | A1 * | 4/2005 | Smith | 510/506 |
| 2006/0025325 | A1 * | 2/2006 | Ryther | 510/446 |
| 2006/0040841 | A1 * | 2/2006 | Lentsch et al. | 510/295 |
| 2006/0040845 | A1 * | 2/2006 | Gladfelter et al. | 510/445 |
| 2006/0105936 | A1 * | 5/2006 | Shi et al. | 510/503 |
| 2006/0111265 | A1 * | 5/2006 | Rypkema et al. | 510/504 |
| 2006/0183656 | A1 * | 8/2006 | Bastigkeit et al. | 510/357 |
| 2006/0281654 | A1 * | 12/2006 | Brooker et al. | 510/375 |
| 2008/0015133 | A1 * | 1/2008 | Rigley et al. | 510/215 |
| 2008/0274930 | A1 * | 11/2008 | Smith et al. | 510/221 |
| 2009/0099058 | A1 * | 4/2009 | Crump et al. | 510/405 |
| 2009/0105111 | A1 * | 4/2009 | Stolte et al. | 510/392 |

* cited by examiner

*Primary Examiner* — Charles I Boyer
(74) *Attorney, Agent, or Firm* — Andrew D. Sorensen; Laura C. DiLorenzo; Amy J. Hoffman

(57) ABSTRACT

Cleaner concentrates, associated cleaners, and associated methods are disclosed. The cleaner concentrates are capable for use in making cleaners that are capable of removing from surfaces fresh, greasy soils and polymerized soils more recently encountered in the food service industry originating from non-trans-fat oils. The cleaner concentrates include one or more alkalinity sources, one or more chelants, one or more surfactants, and as a remainder, water. The one or more alkalinity sources may be present in an amount sufficient to provide a free alkalinity (expressible as $Na_2O$) of greater than about 3.6 wt % and a total alkalinity (expressible as $Na_2O$) of greater than about 6.1 wt %, based on the total weight of the cleaner concentrate. The one or more chelants may be present in an amount sufficient to permit a use of a water having a hardness number up to about 600 ppm (600 mg/L) or more.

17 Claims, No Drawings

CLEANER CONCENTRATE COMPRISING ETHANOLDIGLYCINE AND A TERTIARY SURFACTANT MIXTURE

Aspects of embodiments and embodiments of the present invention relate to cleaner concentrates, associated cleaners, and associated methods for use in removing from surfaces fresh, greasy soils and polymerized soils commonly encountered in the food service industry.

BACKGROUND

Greasy soils are often encountered on surfaces (e.g., floors, hoods, appliances, counter tops, shelves, walls, ceilings, . . . the like, or combinations thereof) in the food service industry. One type of soil can be referred to as fresh, greasy soil, and the other type of soil can be referred to as polymerized soil. Fresh, greasy soils can result from the presence of fatty soil, which can comprise, for example, a neutral fatty acid triglyceride ester and similar neutral fats, and free fatty acids or salts thereof. The fatty acid salts can be formed from a cation such as sodium, calcium, magnesium, ferric, ferrous, . . . the like, or combinations thereof. Polymerized soil refers to fats and fatty derivatives that have likely been polymerized through cross-linking in a manner similar to that of drying oils such as linseed oil. Polymerized soils present a different challenge compared to fresh, greasy soils.

Fresh, greasy soils can deposit on a surface and these greasy soil deposits can polymerize and adhere to the surface through cross linking. Among the many examples of types of surfaces often encountered in the food service industry are stainless steel, polymeric, glass, ceramic, concrete, composite surfaces, . . . the like, or combinations thereof of equipment and/or floors.

Traditionally, an alkaline or neutral cleaner is used for removing fresh, greasy soil from the floor and an acidic cleaner is used for removing polymerized soil from the floor surface. An alkaline product to clean fresh, greasy soils is available under the name KADET®-AF All Surface Floor Cleaner from Kay Chemical Company. An acidic product to clean fresh greasy soil and polymerized soils is available under the name KADET® Quarry Tile Floor Cleaner from Kay Chemical Company.

It would therefore be desirable to provide a single cleaner concentrate, associated cleaners, and associated methods to address the different challenges presented by fresh, greasy soils and polymerized soils encountered in the food service industry.

SUMMARY

Aspects of embodiments and embodiments of the present invention meet these and other needs by providing, without limitation, cleaner concentrates, associated cleaners, and associated methods for use in removing from surfaces fresh, greasy soils and/or polymerized soils. Advantageously, such cleaner concentrates are formulated to be capable of use as a plurality of cleaners for removing soils from surfaces. In aspects of embodiments, such soils originate from a fat and/or oil comprising one of a low trans-fat fat or oil or a non-trans-fat fat or oil and may include fats from food processing.

In aspects of embodiments of the present invention, cleaner concentrates include one or more alkalinity sources, one or more chelants, one or more surfactants, and, as a remainder, water. The one or more alkalinity sources may be present in an amount sufficient to provide a free alkalinity (expressed as $Na_2O$) of greater than about 3.6 wt %, based on the total weight of the cleaner concentrate, and a total alkalinity (expressed as $Na_2O$) of greater than about 6.1 wt %, based on the total weight of the cleaner concentrate. The one or more chelants may be present in an amount sufficient to permit a use of a water having a hardness number up to about 600 ppm (600 mg/L) or more. The one or more surfactants may be present in an amount from about 0 wt % to about 39 wt %, based on the total weight of the cleaner concentrate. The remainder to 100 wt % may be water, based on the total weight of the cleaner concentrate.

In aspects of embodiments, cleaner concentrates further include one or more buffers in an amount sufficient to substantially maintain a pH in range from about 8 to 14. In other aspects, cleaner concentrates further include from about 0 wt % to about 9 wt % of one or more hydrotropes. In yet other aspects, the cleaner concentrates further include one or more buffers and one or more hydrotropes.

When used, one or more buffers may include a base and a complementary acid. Examples of a base include, without limitation, one or more of a borate (e.g., tetraborate, borax, . . . the like, or combinations thereof), bicarbonate (e.g., sodium bicarbonate, mixtures of sodium bicarbonate and sodium carbonate, . . . the like, or combinations thereof), carbonate (e.g., sodium carbonate), phosphate (e.g., disodium phosphate, monosodium phosphate, mixtures of disodium phosphate and trisodium phosphate, . . . the like, or combinations thereof), . . . the like, or combinations thereof. Examples of complementary acids include, without limitation, one or more of an alkali metal salt of an acid, alkali metal salt of an organic acid, or organic amine salt of an organic acid, such as, without limitation, sodium, potassium or triethanolamine salts of acetic acid, citric acid, lactic acid, tartaric acid, . . . the like, or combinations thereof. As to an amount of one or more buffers, in one aspect it may be about 0.1 wt % to about 10 wt %, based on the total weight of the cleaner concentrate. In another aspect, the one or more buffers may be about 0.1 wt % to about 5 wt %, based on the total weight of the cleaner concentrate. In yet another aspect, an amount of one or more buffers may be about 0.1 wt % to about 1 wt %, based on the total weight of the cleaner concentrate.

Without limitation, some examples of one or more hydrotropes that may be used include, without limitation, one or more of xylenesulfonic acid, sodium salt; toluenesulfonic acid, sodium salt; xylenesulfonic acid, ammonium salt; cumenesulfonic acid, sodium salt; cumenesulfonic acid, ammonium salt; xylenesulfonic acid, calcium salt; xylenesulfonic acid, potassium salt; toluenesulfonic acid, potassium salt; glycol; glycol ether; monoproprionate; diproprionate; . . . the like, or combinations thereof.

Without limitation, some examples of one or more alkalinity sources include one or more of an alkanolamine, alkali metal carbonate, alkali metal hydroxide, phosphate, borate, or silicate. Further, as well as specific, examples of one or more alkalinity sources are set forth in the description that follows below. As to an amount of one or more alkalinity sources, in one aspect it may be that amount that is sufficient to provide a free alkalinity (expressed as $Na_2O$) from about 6 wt % to about 9 wt %, based on the total weight of the cleaner concentrate, and a total alkalinity (expressed as expressed as $Na_2O$) of greater than about 7 wt % to about 10 wt %, based on the total weight of the cleaner concentrate. To that end, in one aspect the one or more alkalinity sources may be from about 3 wt % to about 24 wt %, based on the total weight of the cleaner concentrate. In another aspect, the one or more alkalinity sources may be from about 6 wt % to about 18 wt %, based on the total weight of the cleaner concentrate. In yet another aspect, the one or more alkalinity sources may be from about 8 wt % to about 12 wt %, based on the total weight of the cleaner concentrate.

Without limitation, some examples of one or more chelants comprise one or more of an aminocarboxylate, phosphate, phosphonate, polyacrylate, gluconate, or citrate. Further, as well as specific, examples of one or more chelants are set forth in the description that follows below. As to an amount of one or more chelants, in one aspect it may be from about 5 wt % to about 16 wt %, based on the total weight of the cleaner concentrate. In other aspects, the one or more chelants may be from about 6 wt % to about 12 wt %, based on the total weight of the cleaner concentrate. In yet other aspects, the one or more chelants may be from about 6 wt % to about 10 wt %, based on the total weight of the cleaner concentrate. In still yet other aspects, the one or more chelants may be from about 6 wt % to about 8 wt %, based on the total weight of the cleaner concentrate.

Without limitation, some examples of one or more surfactants comprise one or more of an anionic surfactant, nonionic surfactant, cationic surfactant, or amphoteric (or zwitterionic surfactant). Further, as well as specific, examples of one or more surfactants are set forth in the description that follows below. As to an amount of one or more surfactants, in one aspect it may be from about 0 wt % to about 39 wt %, based on the total weight of the cleaner concentrate. In another aspect, the one or more surfactants may be about 2 wt % to about 30 wt %, based on the total weight of the cleaner concentrate. In yet another aspect, an amount of one or more surfactants may be about 4 wt % to about 15 wt %, based on the total weight of the cleaner concentrate.

Accordingly, some aspects of embodiments and embodiments of the present invention are directed to cleaner concentrates formulated to be capable of use as a plurality of cleaners. Such cleaner concentrates include one or more alkalinity sources, one or more chelants, one or more surfactants, and, as a remainder, water. The one or more alkalinity sources may be present in an amount sufficient to provide a free alkalinity (expressed as $Na_2O$) of greater than about 3.6 wt %, based on the total weight of the cleaner concentrate, and a total alkalinity (expressed as expressed as $Na_2O$) of greater than about 6.1 wt %, based on the total weight of the cleaner concentrate. The one or more chelants may be present in an amount sufficient to permit a use of a water having a hardness number up to about 600 ppm (600 mg/L) or more. The one or more surfactants may be present in an amount from about 0 wt % to about 39 wt %, based on the total weight of the cleaner concentrate. The remainder to 100 wt % may be water, based on the total weight of the cleaner concentrate.

Other aspects of embodiments and embodiments of the present invention are directed to cleaner concentrates formulated to be capable of use as a plurality of cleaners. Such cleaner concentrates include one or more alkalinity sources, one or more chelants, one or more surfactants, and, as a remainder, water. The one or more alkalinity sources may be present in an amount sufficient to provide a free alkalinity (expressed as $Na_2O$) of from about 3.6 wt % to about 9 wt %, based on the total weight of the cleaner concentrate, and a total alkalinity (expressed as expressed as $Na_2O$) of greater than about 6.1 wt % to about 10 wt %, based on the total weight of the cleaner concentrate. The one or more chelants may be from about 5 wt % to about 16 wt %, based on the total weight of the cleaner concentrate. The one or more surfactants may be from about 2 wt % to about 30 wt %, based on the total weight of the cleaner concentrate. The remainder to 100 wt % may be water, based on the total weight of the cleaner concentrate.

Yet other aspects of embodiments and embodiments of the present invention are directed to cleaner concentrates formulated to be capable of use as a plurality of cleaners. Such cleaner concentrates include one or more alkalinity sources, one or more chelants, one or more surfactants, one or more buffers, one or more hydrotropes, and, as a remainder, water. The one or more alkalinity sources may be present in an amount sufficient to provide a free alkalinity (expressed as $Na_2O$) of from about 3.6 wt % to about 9 wt %, based on the total weight of the cleaner concentrate, and a total alkalinity (expressed as $Na_2O$) of greater than about 6.1 wt % to about 10 wt %, based on the total weight of the cleaner concentrate. The one or more chelants may be from about 5 wt % to about 16 wt %, based on the total weight of the cleaner concentrate, so as to permit a use of a water having a hardness number up to about 600 ppm (600 mg/L) or more. The one or more surfactants may be from about 2 wt % to about 30 wt %, based on the total weight of the cleaner concentrate. The one or more buffers may present in an amount sufficient to substantially maintain a pH in range from about 8 to 14. The one or more hydrotropes may be from about 0 wt % to about 9 wt %, based on the total weight of the cleaner concentrate. The remainder to 100 wt % may be water, based on the total weight of the cleaner concentrate.

Still yet other aspects of embodiments and embodiments of the present invention are directed to cleaners formulated to be capable of removing from a surface soils originating from a fat and/or oil comprising one of a low trans-fat fat or oil or a non-trans-fat fat or oil and that may include fats from food processing. Such cleaners include one or more alkalinity sources, one or more chelants, one or more surfactants, and, as a remainder, water. The one or more alkalinity sources may be from about 12 ppm to about 27,000 ppm (2.7 wt %), based on the total weight of the cleaner. The one or more chelants may be from about 20 ppm to about 18,000 ppm (1.8 wt %), based on the total weight of the cleaner. The one or more surfactants may be up to about 43,000 ppm (4.3 wt %), based on the total weight of the cleaner. The remainder to 100 wt % may be water, based on the total weight of the cleaner. Such water may have a hardness number up to about 600 ppm (600 mg/L) or more. In some aspects, cleaners further include up to about 10,000 ppm (1.0 wt %) of one or more hydrotropes, based on the total weight of the cleaner. In yet other aspects, the cleaners further include one or more buffers and one or more hydrotropes. When used, an amount of one or more buffers may be up to about 11,000 ppm (1.1 wt %), based on the total weight of the cleaner. Further, as well as more specific, examples of amounts of the number of ingredients are set forth in the description section that follows below.

Still yet other aspects of embodiments and embodiments of the present invention are directed to cleaners formulated to be capable of removing from a surface soils originating from a fat and/or oil comprising one of a low trans-fat fat or oil or a non-trans-fat fat or oil and that may include fats from food processing. Such cleaners include one or more alkalinity sources, one or more chelants, one or more surfactants, one or more buffers, one or more hydrotropes, and, as a remainder, water. Such water may have a hardness number up to about 600 ppm (600 mg/L) or more. In some aspects, the one or more alkalinity sources may be from about 12 ppm to about 27,000 ppm (2.7 wt %), based on the total weight of the cleaner. In other aspects, the one or more chelants may be from about 20 ppm to about 18,000 ppm (1.8 wt %), based on the total weight of the cleaner, so as to permit a use of a water having a hardness number up to about 600 ppm (600 mg/L) or more. In yet other aspects, the one or more surfactants may be up to about 43,000 ppm (4.3 wt %), based on the total weight of the cleaner. In still yet other aspects, the one or more buffers may be up to about 11,000 ppm (1.1 wt %), based on the total weight of the cleaner. In still further aspects, the one or more hydrotropes may be up to about 10,000 ppm (1.0 wt %), based on the total weight of the cleaner. The remainder to 100 wt % may be water, based on the total weight of the cleaner. Further, as well as more specific, examples of amounts of the number of ingredients are set forth in the description section that follows below.

Still yet other aspects of embodiments and embodiments of the present invention are directed to methods for removing from a surface soils originating from a fat and/or oil comprising one of a low trans-fat fat or oil or a non-trans-fat fat or oil and that may include fats from food processing. Such methods include the steps of formulating a cleaner, communicating the cleaner with a soiled surface, and removing any residue from the surface thereby cleaning of the surface. The formulating includes combining a sufficient amount of cleaner concentrate and water. Such cleaner concentrate includes one or more alkalinity sources, one or more chelants, one or more surfactants, and, as a remainder, water. The one or more alkalinity sources may be present in an amount sufficient to provide a free alkalinity (expressed as $Na_2O$) of greater than about 3.6 wt %, based on the total weight of the cleaner concentrate, and a total alkalinity (expressed as $Na_2O$) of greater than about 6.1 wt %, based on the total weight of the cleaner concentrate. The one or more chelants may be present in an amount sufficient to permit a use of a water having a hardness number up to about 600 ppm (600 mg/L) or more. The one or more surfactants may be present in an amount from about 0 wt % to about 39 wt %, based on the total weight of the cleaner concentrate. The remainder to 100 wt % may be water, based on the total weight of the cleaner concentrate. The contacting of the cleaner with the soiled surface includes doing so for at least a sufficient amount of time to allow the cleaner to interact with the soil of the soiled surface. In aspects, the formulating includes combining a sufficient amount of cleaner concentrate with water so as to be capable of removing a soil resulting from one of a low trans-fat fat or oil or a non-trans-fat fat or oil comprising one or more fats and/or oils having an iodine value from about 38 to about 132 calculated, using the formula:

$$IV=\{3.04(\text{wt \% linolenic acid})+2.02(\text{wt \% linoleic acid})+(\text{wt \% oleic acid})\}/1.16.$$

In other aspects, the one or more fats and/or oils of the soil include one or more triglycerides. In yet other aspects, at least a portion of the triglycerides are polymerized.

In some aspects, the formulating involves combining at least about 0.05 ounces of cleaner concentrate with water to make about 1 gallon of cleaner. In other aspects, the formulating involves combining from about 0.05 to about 12.8 ounces of cleaner concentrate with water to make about 1 gallon of cleaner so as to be capable of cleaning the soil from a floor. In still other aspects, the formulating involves combining from about 0.05 to about 4 ounces of cleaner concentrate with water to make about 1 gallon of cleaner so as to be capable of cleaning the soil from a floor. In still yet other aspects, the formulating involves combining from about 0.1 to about 8 ounces of cleaner concentrate with water to make about 1 gallon of cleaner so as to be capable of cleaning the soil from a floor (see e.g., test with soiled quarry tile below). In still further aspects, the formulating involves combining from about 0.25 to about 4 ounces of cleaner concentrate with water to make about 1 gallon of cleaner so as to be capable of cleaning the soil from a floor (see e.g., test with soiled quarry tile below).

Alternatively, some aspects of the formulating involve combining at least about 0.05 ounces of cleaner concentrate with about 9 ounces of water (i.e., cleaner concentrate:water volume ratio=at least about 1:180). In other aspects, the formulating involves combining from about 0.18 to about 9 ounces of cleaner concentrate with about 9 ounces of water (i.e., cleaner concentrate:water volume ratio=from about 1:50 to about 1:1) so as to be capable of cleaning the soil from a surface (see e.g., test with a soiled type 304 stainless steel tile below). In yet other aspects, the formulating involves combining from about 0.45 to about 2.25 ounces of cleaner concentrate with about 9 ounces of water (i.e., cleaner concentrate:water volume ratio=from about 1:20 to about 1:4) so as to be capable of cleaning the soil from a surface (see e.g., test with a soiled type 304 stainless steel tile below).

Still yet other aspects of embodiments and embodiments of the present invention are directed to methods of making a cleaner concentrate. Such cleaner concentrate is useable for making a plurality of cleaners capable of removing from a surface soils originating from a fat and/or oil comprising one of a low trans-fat fat or oil or a non-trans-fat fat or oil and that may include fats from food processing. The method includes providing one or more alkalinity sources, providing one or more chelants, providing one or more surfactants, and providing, as a remainder, water. The providing one or more alkalinity sources involves providing an amount sufficient to provide a free alkalinity (expressed as $Na_2O$) of greater than about 3.6 wt %, based on the total weight of the cleaner concentrate, and a total alkalinity (expressed as $Na_2O$) of greater than about 6.1 wt %, based on the total weight of the cleaner concentrate. The providing of the one or more chelants involves providing an amount sufficient to permit a use of a water having a hardness number up to about 600 ppm (600 mg/L) or more. The providing of one or more surfactants involves providing from about 0 wt % to about 39 wt %, based on the total weight of the cleaner concentrate. The providing, as a remainder of water involves providing to 100 wt % of water, based on the total weight of the cleaner concentrate.

Still yet other aspects of embodiments and embodiments of the present invention are directed to cleaners formulated to be capable of removing from a surface soils originating from a fat and/or oil comprising one of a low trans-fat fat or oil or a non-trans-fat fat or oil and that may includes fats from food processing. Such cleaners include one or more alkalinity sources, one or more chelants, one or more surfactants, and, as a remainder, water. The one or more alkalinity sources may be from about 186 ppm to about 135,000 ppm (13.5 wt %), based on the total weight of the cleaner. The one or more chelants may be from about 310 ppm to about 90,000 ppm (9.0 wt %), based on the total weight of the cleaner. The one or more surfactants may be up to about 22 wt %, based on the total weight of the cleaner. The remainder to 100 wt % may be water, based on the total weight of the cleaner. Such water may have a hardness number up to about 600 ppm (600 mg/L) or more. Further, as well as more specific, examples of amounts of the number of ingredients are set forth in the description section that follows below.

Still yet other aspects of embodiments and embodiments of the present invention are directed to cleaners formulated to be capable of removing from a surface soils originating from a fat and/or oil comprising one of a low trans-fat fat or oil or a non-trans-fat fat or oil and that may include fats from food processing. Such cleaners include one or more alkalinity sources, one or more chelants, one or more surfactants, one or more buffers, one or more hydrotropes, and, as a remainder, water. In some aspects, the one or more alkalinity sources may be from about 186 ppm to about 135,000 ppm (13.5 wt %), based on the total weight of the cleaner. In other aspects, the one or more chelants may be from about 310 ppm to about 90,000 ppm (9.0 wt %), based on the total weight of the cleaner, so as to permit a use of a water having a hardness number up to about 600 ppm (600 mg/L) or more. In still other aspects, the one or more surfactants may be from about up to about 22 wt %, based on the total weight of the cleaner. In still yet other aspects, the one or more buffers may be up to about 5.6 wt %, based on the total weight of the cleaner. In still further aspects, the one or more hydrotropes may be from up to about 5 wt %, based on the total weight of the cleaner. The remainder to 100 wt % may be water, based on the total weight of the cleaner. Further, as well as more specific, examples of amounts of the number of ingredients are set forth in the description section that follows below.

Numerous other aspects of embodiments, embodiments, features, and advantages of the present invention will appear from the following description and the accompanying drawings. In the description and/or the accompanying drawings, reference is made to exemplary aspects of embodiments and/or embodiments of the invention. Such aspects of embodiments and/or embodiments do not represent the full scope of the invention. Reference should therefore be made to the claims herein for interpreting the full scope of the invention. In the interest of brevity and conciseness, any ranges of values set forth in this specification contemplate all values within the range and are to be construed as support for claims reciting any sub-ranges having endpoints which are real number values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5.

These and other aspects, advantages, and salient features of the present invention will become apparent from the following description and the appended claims.

DESCRIPTION

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

I. Cleaner Concentrate

As noted, aspects of embodiments and embodiment of the present invention relate to the cleaner concentrates and/or cleaners that may include a number of ingredients. Such ingredients may provide desired characteristics to the resulting cleaner concentrates and in turn the resulting cleaners. Examples of such ingredients include one or more alkalinity sources, one or more surfactants, and one or more chelants, optionally, with any one of one or more solvents, one or more hydrotropes, one or more buffers, or any combination of any two or more of the preceding. A description of each class of ingredients of the cleaner concentrates and/or cleaners follows.

A. One or More Alkalinity Sources

Aspects of embodiments of the present invention relate to the one or more alkalinity sources and cleaner concentrates and/or cleaners. Suitable alkalinity sources include, but are not limited to, one or more organic alkalinity sources, one or more inorganic alkalinity sources, or combinations thereof. Suitable organic alkalinity sources include, but are not limited to, strong nitrogen bases including, for example, ammonia (ammonium hydroxide), monoethanolamine, monopropanolamine, diethanolamine, dipropanolamine, triethanolamine, tripropanolamine, . . . the like, or combinations thereof. Suitable inorganic alkalinity sources include, but are not limited to, alkali metal hydroxides (e.g., sodium hydroxide, potassium hydroxide, lithium hydroxide, . . . the like, or combinations thereof), alkali metal carbonates (e.g., sodium carbonate, potassium carbonate, sodium bicarbonate, potassium bicarbonate, sodium sesquicarbonate, potassium sesquicarbonate, . . . the like, or combinations thereof), alkali metal silicates (e.g., alkali metal orthosilicates {e.g., sodium orthosilicate, . . . the like, or combinations thereof}; alkali metal meta-silicates {e.g., sodium metasilicate, sodium metasilicate pentahydrate, sodium metasilicate hexahydrate, sodium metasilicate octahydrate, sodium metasilicate nanohydrate, potassium metasilicate, potassium metasilicate hemihydrate, . . . the like, or combinations thereof}; alkali metal di-silicates {e.g., sodium disilicate, potassium disilicate, potassium disilicate monohydrate, . . . the like, or combinations thereof}; alkali metal tri-silicates {e.g., sodium trisilicate, potassium tetrasilicate, . . . the like, or combinations thereof}; alkali metal tetrasilicates {e.g., sodium tetrasilicate, potassium tetrasilicate monohydrate . . . and the like, or combinations thereof}; sodium silicate; potassium silicate; sodium sesquisilicate; sodium sesquisilicate pentahydrate; potassium silicate monohydrate; . . . and the like, or combinations thereof), alkali metal borates (e.g., sodium borate, potassium borate, . . . the like, or combinations thereof), alkali metal oxides (e.g., sodium oxide, potassium oxide, . . . the like, or combinations thereof), . . . the like, or combinations thereof.

As to an amount of one or more alkalinity sources, in one aspect it may be that amount that is sufficient to provide free alkalinity (expressed as $Na_2O$) of greater than about 3.6 wt %, based on the total weight of the cleaner concentrate, and a total alkalinity (expressed as expressed as $Na_2O$) of greater than about 6.1 wt %, based on the total weight of the cleaner concentrate. In another aspect, the one or more alkalinity sources may be that amount that is sufficient to provide a free alkalinity (expressed as $Na_2O$) comprises from about 6 wt % to about 9 wt %, based on the total weight of the cleaner concentrate, and a total alkalinity (expressed as expressed as $Na_2O$) of greater than about 7 wt % to about 10 wt %, based on the total weight of the cleaner concentrate. To that end, in some aspects, the one or more alkalinity sources may be from about 3 wt % to about 24 wt %, based on the total weight of the cleaner concentrate. In other aspects, the one or more alkalinity sources may be from about 6 wt % to about 18 wt %, based on the total weight of the cleaner concentrate. In yet other aspects, the one or more alkalinity sources may be from about 8 wt % to about 12 wt %, based on the total weight of the cleaner concentrate.

A number of commercially available alkalinity sources may be suitable for use in aspects of embodiments or embodiments of the present invention. Commercially available alkalinity sources may be obtained from a variety of vendors including, but not limited to, PPG Industries (Pittsburgh, Pa.), Dow Chemical Company (Midland, Mich.), and Angus Chemical Company (Buffalo Grove, Ill.). For example, suitable commercially available amino alcohols include, but are not limited to, AMP-95™ primary amino alcohol (2-Amino-2-methyl-1-propanol+5% water) and AMP-90™ amino alcohol (2-Amino-2-methyl-1-propanol+10% water) available from Angus Chemical Company (Buffalo Grove, Ill.). Suitable commercially available caustic soda include, but are not limited to, liquid caustic soda (sodium hydroxide) as 50%

(alkali equivalent, wt % $Na_2O$ about 39%) and 73% (alkali equivalent, wt % $Na_2O$ about 57%) solutions in water available from PPG Industries. (Pittsburgh, Pa.). Suitable commercially available alkyl alkanolamines include, but are not limited to, monoethanolamine ($HOCH_2CH_2NH_2$) as MEA grade, MEA LFG grade (an 85% solution of monoethanolamine with 15% water), and MEA ICF grade available from Dow Chemical Company (Midland, Mich.).

B. One or More Surfactants

Aspects of embodiments of the present invention relate to the one or more one or more surfactants and cleaner concentrates and/or cleaners. Suitable surfactants include, but are not limited to, natural surfactants (e.g., surfactants based on natural components such as fatty acids, coconut oil, . . . the like, or combinations thereof), anionic surfactants, cationic surfactants, nonionic surfactants, amphoteric surfactants (or zwitterionic surfactant), . . . the like, or combinations thereof. Natural surfactants include, but are not limited to, soaps such as coconut-based soap solutions.

Anionic surfactants include, but are not limited to, one or more of a carboxylate such as, without limitation, alkylcarboxylates (e.g., carboxylic acid and/or its salts), polyalkoxycarboxylates (e.g., polycarboxylic acid and/or its salts), alcohol ethoxylate carboxylates, nonylphenol ethoxylate carboxylates, . . . the like, or combinations thereof; sulfonate such as, without limitation, alkylsulfonates, alkylbenzenesulfonates (e.g., dodecyl benzene sulfonic acid and/or its salts), alkylarylsulfonates, sulfonated fatty acid esters, . . . the like, or combinations thereof; sulfate such as, without limitation, sulfated alcohols, sulfated alcohol ethoxylates, sulfated alkylphenols, alkylsulfates, sulfosuccinates, alkylether sulfates, . . . the like, or combinations thereof; phosphate esters such as, without limitation, alkylphosphate esters, . . . the like, or combinations thereof; . . . the like; or combinations thereof. Exemplary anionic surfactants include sodium alkylarylsulfonate, alpha-olefinsulfonate, fatty alcohol sulfates, . . . the like, or combinations thereof.

Cationic surfactants include, but are not limited to, alkoxylated cationic ammonium surfactants, . . . the like, or combinations thereof.

Nonionic surfactants include, but are not limited to, alkoxylates of alkyl phenols and alcohols, alkanolamides, alkyl polyglycocides, . . . the like, or combinations thereof. Such nonionic surfactants include one or more polyalkylene oxide polymer as a portion of the surfactant molecule. Examples of nonionic surfactants include, without limitation, benzyl-, methyl-, ethyl-, propyl-, butyl- and other like alkyl-capped polyethylene glycol ethers of fatty alcohols, . . . the like, or combinations thereof; polyalkylene oxide free nonionics such as, without limitation, alkyl polyglycosides, . . . the like, or combinations thereof; sorbitan esters, sucrose esters, sorbitan esters ethoxylates, sucrose ester ethoxylates, . . . the like, or combinations thereof; alkoxylated ethylene diamine; alcohol alkoxylates such as, without limitation, alcohol ethoxylates (SURFONIC® L12-6 commercially available from Huntsman), alcohol ethoxylate propoxylates, alcohol propoxylates, alcohol propoxylate ethoxylate propoxylates, alcohol ethoxylate butoxylates, . . . the like, or combinations thereof; nonylphenol ethoxylate, polyoxyethylene glycol ethers, . . . the like, or combinations thereof; carboxylic acid esters such as, without limitation, glycerol esters, polyoxyethylene esters, ethoxylated and glycol esters of fatty acids, . . . the like, or combinations thereof; carboxylic amides such as, without limitation, diethanolamine condensates, monoalkanolamine condensates, polyoxyethylene fatty acid amides, . . . the like, or combinations thereof; and polyalkylene oxide block copolymers including an ethylene oxide/propylene oxide block copolymer such as those commercially available under the trademark PLURONIC® (BASF), . . . the like, or combinations thereof; other like nonionic compounds; or combinations thereof.

Amphoteric surfactants (or zwitterionic surfactants) include, but are not limited to, imidazoline derivatives, betaines, imidazolines, sultaines, propionates, amine oxides, . . . the like, or combinations thereof.

Silicone surfactants such as the ABIL® B8852 may also be used.

Some aspects of embodiments and embodiments of the present invention relate to cleaner concentrates and/or cleaners and the one or more surfactants that include, but are not limited to, coconut-based soap solutions, ethoxylated alcohols containing from about 6 to about 24 carbon atoms and as many as 12 ethoxylate groups, propoxylated quat (i.e., quaternary surfactants), . . . the like, or combinations thereof. In aspects of one embodiment, the cleaner concentrates comprises a coconut-based soap solution. In aspects of another embodiment, the cleaner concentrates comprises a combination of surfactants, wherein the combination comprises two or more ethoxylated alcohols wherein each alcohol has from about 10 to about 16 carbon atoms and up to about 8 ethoxylate groups.

As to an amount of one or more surfactants, in some aspects it may be may be from about 0 wt % to about 39 wt %, based on the total weight of the cleaner concentrate. In other aspects, the one or more surfactants may be from about 2 wt % to about 30 wt %, based on the total weight of the cleaner concentrate. In yet other aspects the one or more surfactants may be from about 4 wt % to about 15 wt %, based on the total weight of the cleaner concentrate.

A number of commercially available surfactants may be suitable for use in aspects of embodiments and/or embodiments of the present invention. Commercially available surfactants may be obtained from a variety of vendors including, but not limited to, Cognis Oleochemicals LLC and/or Cognis USA (Cincinnati, Ohio), Dow Chemical Company (Midland, Mich.), Huntsman Performance Products (The Woodlands, Tex.), Tomah Products, Inc (Milton, Wis.), Air Products and Chemicals, Inc (Allentown, Pa.), Stepan Company (Northfield, Ill.), Rhodia Inc. (Cranbury, N.J.), Clariant Corporation (Charlotte, N.C.), and Nease Corporate (Cincinnati, Ohio). For example, suitable commercially available amphoteric surfactants include, but are not limited to, MIRANOL® HMA sodium lauroampho acetate (38% solids) and MIRANOL® ULTRA L32 sodium lauroampho acetate available from Rhodia Novecare (Cranbury, N.J.). Suitable commercially available linear alcohol ethoxylates include, but are not limited to, SURFONIC® L12-6 six-mole ethoxylate of linear, primary 10-12 carbon number alcohol available from Huntsman Performance Products (The Woodlands, Tex.). Suitable commercially available alkyl sulfates include, but are not limited to, POLYSTEP® B-29 sodium octyl sulfate available from Stepan Company (Northfield, Ill.). Suitable commercially available nonionic surfactants include, but are not limited to, oxo-alcohol polyglycol ethers such as GENAPOL® UD 070 C11-oxo-alcohol polyglycol ether (7 EO) available from Clariant Corporation (Cranbury, N.J.). Suitable commercially available linear alkylbenzene sulfonic acids and their salts include, but are not limited to, NAXSOFT® 98S dodecyl Benzene Sulfonic Acid and NAXSOFT® 40S Sodium dodecyl Benzene sulfonate available from Nease Corporate (Cincinnati, Ohio).

C. One or More Chelants (and/or Sequestrants)

Aspects of embodiments of the present invention relate to one or more chelants and cleaner concentrates and/or cleaners. To that end, the cleaner concentrates and/or cleaners of the present include one or more chelants (used interchangeably herein with one or more sequestrants) that prevent the formation of precipitates or other salts. In one aspect the one or more chelants may include any one or more materials that can bind ions (e.g., one or more molecules capable of coordinating the metal ions commonly found in service water) and thereby preventing the ions from interfering with the functioning of the other ingredients within cleaner concentrates and/or cleaners. In another aspect, the one or more chelants also may function to remove polymerized (e.g., by oxidation, heat, free radical, . . . the like, or combinations thereof) and/or carbonized fats and oils from a surface and suspend these products in a cleaner. Any number of chelants may be used in accordance with aspects of embodiments and/or embodiments of the present invention. Examples of one or more chelants include, but are not limited to, salts of amino carboxylic acids, phosphonic acid salts, gluconates such as gluconic acid and gluconic acid salts, phosphates, water soluble acrylic polymers, iminodisuccinate, . . . the like, or combinations thereof.

Thus, it will be appreciated that suitable chelants for use in the present invention include, but are not limited to, organic compounds, inorganic compounds, or combinations thereof. The number of covalent bonds capable of being formed by a chelant upon a single hardness ion may be reflected by labeling the chelants as bidentate (2), tridentate (3), tetradendate (4), . . . the like.

In aspects of one embodiment, the one or more chelants are organic. Nonlimiting examples of organic chelants include the salts or acid form of nitriloacetic acid and its derivatives, amino carboxylates, organic phosphonates, amides, polycarboxylates, salicylates and their derivatives, sodium aluminosilicates, zeolites, derivatives of polyamino compounds, . . . the like, or combinations thereof. Nonlimiting examples of nitriloacetic acid derivatives include, but are not limited to, sodium nitriloacetate, magnesium nitriloacetate, . . . the like, or combinations thereof. Nonlimiting examples of amino carboxylates include sodium iminosuccinates, . . . the like, or combinations thereof. Nonlimiting examples of organic phosphonates include amino tri(methylene phosphonate), hydroxyethylidene diphosphonate, diethylenetriamine penta-(methylenephosphonate), ethylenediamine tetra(methylene-phosphonate), . . . the like, or combinations thereof.

Nonlimiting examples of polycarboxylates include citric acid and it salts and derivatives, sodium glutarate, potassium succinate, polyacrylic acid and its salts and derivatives, copolymers, . . . the like, or combinations thereof. Nonlimiting examples of polyamino compounds include ethylene diamine (e.g., ethylenediaminetetraacetic acid {EDTA}, ethylenediaminoetetraproprionic acid), ethylene triamine (e.g., diethyltriaminepentaacetic acid {DTPA}), ethylene tetraamine (e.g., triethylenetetraaminoehexaacetic acid {TTHA}), hydroxyethylene diamine (e.g., N-hydroxyethyliminodiacetic acid, nitrolotriacetic acid {NTA}, N-hydroxyethyl-ethylenediaminetriacetic acid {HEDTA}), ethanoldiglycine (EDG a.k.a. hydroxyethyliminodiacetic acid {HEIDA}), diethanolglycine (DEG), 1,3-propylenediaminoetetraacetic acid (PDTA), dicarboxymethyl glutamic acid (GLDA), methylglycine-N-N-diacetic acid (MGDA), iminodisuccinate acid (IDA), their respective alkali metal (e.g., Li, Na, K, . . . the like, or combinations thereof) salts, their respective ammonium salts, their respective substituted ammonium salts, their derivatives, . . . the like, or combinations thereof.

Nonlimiting examples of polyacrylic acid and its salts and derivatives include water soluble acrylic polymers used to condition the cleaners under end use conditions. Such polymers include, but are not limited to, polyacrylic acid, polymethacrylic acid, acrylic acid, acrylic acid-methacrylic acid copolymers, polymaleic acid, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, . . . the like, or combinations thereof or copolymers thereof. Water soluble salts or partial salts of these polymers such as their respective alkali metal (e.g., sodium, potassium, or combinations thereof) or ammonium salts can also be used.

In one aspect, the weight average molecular weight of the polymers may be from about 4000 to about 12,000. In another aspect, polymers include, but are not limited to, polyacrylic acid, the partial sodium salts of polyacrylic acid or sodium polyacrylate having an average molecular weight within the range of 4000 to 8000.

Nonlimiting examples of phosphonates, include, but are not limited to, phosphonic acids and phosphonic acid salts. Nonlimiting examples of phosphonic acids, but are not limited to, mono, di, tri and tetra-phosphonic acids which can also contain groups capable of forming anions under alkaline conditions such as carboxy, hydroxy, thio, . . . the like, or combinations thereof. Among these are phosphonic acids having the formula $R_1N[C_2PO_3H_2]_2$ or $R_2C(PO_3H_2)_2OH$, wherein $R_1$ may be -[(lower) alkylene]$N[CH_2PO_3H_2]_2$ or a third $(C_2PO_3H_2)$ moiety; and wherein $R_1$ is selected from the group consisting of $C_1$-$C_6$ alkyl.

Also other nonlimiting examples of phosphonic acid, but are not limited to, a low molecular weight phosphonopolycarboxylic acid such as one having about 2-4 carboxylic acid moieties and about 1-3 phosphonic acid groups. Such acids include 1-phosphono-1-methylsuccinic acid, phophonosuccinic acid, 2-phosphonobutane-1,2,4-tricarboxylic acid, . . . the like, or combinations thereof.

In aspects of another embodiment, the one or more chelants are inorganic. Nonlimiting examples of inorganic chelants include alkali metal carbonates (e.g., sodium carbonate, potassium carbonate, . . . the like, or combinations thereof); alkali metal orthophosphates (e.g., sodium orthophosphate, potassium orthophosphate, . . . the like, or combinations thereof); alkali metal pyrophosphate (e.g., sodium pyrophosphate, potassium pyrophosphate, . . . the like, or combinations thereof); alkali metal polyphosphates (e.g., sodium tripolyphosphate, potassium polyphosphate, sodium hexametaphosphate, . . . the like, or combinations thereof); magnesium phosphate; sodium phosphate; tetramethylammonium phosphate; . . . the like; or combinations thereof.

As to an amount of one or more chelants, in one aspect it may be that amount that is sufficient to permit a use of a water having a hardness number up to about 600 ppm (600 mg/L) or more. To that end, in some aspects the one or more chelants may be from about 5 wt % to about 16 wt %, based on the total weight of the cleaner concentrate. In other aspects the one or more chelants may be from about 6 wt % to about 12 wt %, based on the total weight of the cleaner concentrate. In yet other aspects the one or more chelants may be from about 6 wt % to about 10 wt %, based on the total weight of the cleaner concentrate. In still yet other aspects the one or more chelants may be from about 6 wt % to about 8 wt %, based on the total weight of the cleaner concentrate.

A number of commercially available chelants may be suitable for use in aspects of embodiments and/or embodiments of the present invention. Commercially available chelants may be obtained from a variety of vendors including, but not limited to, BASF Corporation (Florham Park, N.J.), Dow Chemical Company (Midland, Mich.), and LANXESS Corporation (Pittsburgh, Pa.). For example, suitable commercially available biodegradable methylglycinediacetic acid (MGDA) chelants include, but are not limited to, TRILON® M methylglycinediacetic acid, trisodium salt while aminocarboxylate chelants include, but are not limited to, TRILON® A nitrilotriacetic Acid (NTA), TRILON® B ethylenediaminetetraacetic acid (EDTA), TRILON® C diethylenetriaminepentaacetic acid (DTPA), TRILON® M hydroxyethylethylenediaminetriacetic acid (HEDTA) available from BASF Corporation (Florham Park, N.J.). Also suitable commercially available chelants include, but are not limited to, VERSENE® 2-hydroxyethyliminodiacetic acid, disodium salt (HEIDA) from Dow Chemical Company (Midland, Mich.). Other suitable commercially available biodegradable chelants include, but are not limited to, BAYPURE® tetrasodium iminodisuccinate and BAYPURE® sodium polyaspartate available from LANXESS Corporation (Pittsburgh, Pa.).

D. One or More Solvents

Aspects of embodiments of the present invention relate to one or more solvents and cleaner concentrates and/or cleaners. Suitable solvents include, but are not limited to, water, alcohols, glycols, glycol ethers, esters, . . . the like, or combinations thereof. Suitable alcohols include, but are not limited to, ethanol, isopropanol (propan-2-ol), 2-butoxy ethanol (butyl glycol), 1-decanol, benzyl alcohol, glycerin, monoethanolamine (MEA), . . . the like, or combinations thereof. Suitable glycols include, but are not limited to, ethylene glycol (monoethylene glycol or MEG), diethylene glycol (propylene glycol or butoxy diglycol or DEG), triethylene glycol (TEG), tetraethylene glycol (TETRA EG), glycerin, propylene glycol, dipropylene glycol, hexylene glycol, . . . the like, or combinations thereof.

The one or more solvents may be present in a cleaner concentrate and/or cleaner in an amount that is the remainder to 100 wt %, based on the total weight of the cleaner concentrate or cleaner, as applicable.

With respect to aspects of embodiments and embodiments relating to cleaner concentrates and/or cleaners comprising water, soft through hard water may be used, although soft through hard water may be more desirable. As used herein, the terms:

"soft hardness or soft water" refer to water containing 0 to about 75 parts per million (ppm) {0 to about 75 micrograms per liter (mg/L)} as calcium and magnesium;

"moderately hard hardness" or "moderately hard water" refer to water containing about 76 ppm to about 200 ppm (about 76 to about 200 mg/L) as calcium and magnesium; and "hard hardness" or "hard water" refer to water containing about 201 ppm to about 606 ppm or more (about 201 to about 600 mg/L or more) as calcium and magnesium.

It will thus be appreciated that cleaner concentrates and/or cleaners of the present invention may be formed using water available from any municipal water-treatment facility.

E. One or More Hydrotropes

Aspects of embodiments and embodiments of the present invention relate to one or more hydrotropes and cleaner concentrates and/or cleaners. A hydrotrope is a material often used in a cleaner concentrate and/or cleaner to maintain a single phase neat or aqueous composition or solubilisate (liquid solution). Such hydrotrope may also be used in aspects of embodiments and/or embodiments of the present invention. Hydrotropy is a property that relates to the ability of a material to improve the solubility or miscibility of a substance in liquid phases in which the substance tends to be insoluble. Materials that provide hydrotropy are called hydrotropes and are used in relatively lower concentrations than the materials to be solubilized. A hydrotrope modifies a formulation to increase the solubility of an insoluble substance or creates micellar or mixed micellar structures resulting in a stable suspension of the insoluble substance. The hydrotropic mechanism is not thoroughly understood. Apparently either hydrogen bonding between primary solvent, in this case water, and the insoluble substance are improved by the hydrotrope or the hydrotrope creates a micellar structure around the insoluble substance to maintain the substance in a suspension/solution. According to aspects of embodiments of the present invention, the hydrotropes are useful in maintaining the ingredients of a cleaner concentrate and/or cleaner in a uniform solution (e.g., solubilisate) both during manufacture and when dispersed at the use location. The one or more surfactants according to aspects of embodiments of the invention alone or when combined with a chelant, may be partially incompatible with an aqueous solution and can undergo a phase change or phase separation during storage of the solution. The hydrotrope maintains a single phase solution (e.g., solubilisate) having the ingredients uniformly distributed throughout a cleaner concentrate and/or cleaner in an aqueous or non-aqueous form.

As to an amount of one or more hydrotropes, in one aspect it may be from about 0 wt % to about 9 wt %, based on the total weight of the cleaner concentrate. In other aspects the one or more hydrotropes may be from about 1 wt % to about 9 wt % based on the total weight of the cleaner concentrate. In yet other aspects the one or more hydrotropes may be from about 2 wt % to about 7 wt % based on the total weight of the cleaner concentrate.

Hydrotropes exhibit hydrotropic properties in a broad spectrum of chemical molecule types. Hydrotropes generally include ether compounds, alcohol compounds, anionic surfactants, cationic surfactants, . . . the like, or combinations thereof. One hydrotrope usable according to aspects of embodiments of the invention include aromatic sulfonic acid, sulfonated hydrotropes such as C1-C5 substituted benzene sulfonic acid, naphthalene sulfonic acid, . . . the like, or combinations thereof. Examples of such a hydrotrope are xylene sulfonic acid, toluene sulfonic acid, naphthalene sulfonic acid, salts of xylene sulfonic acid (e.g., xylenesulfonic acid, sodium salt; xylenesulfonic acid, ammonium salt; xylenesulfonic acid, calcium salt; and/or xylenesulfonic acid, potassium salt; cumenesulfonic acid, sodium salt; and/or cumenesulfonic acid, ammonium salt), salts of toluene sulfonic acid (e.g., toluenesulfonic acid, sodium salt; and/or toluenesulfonic acid, potassium salt), salts of naphthalene sulfonic acid, . . . the like, or combinations thereof.

Also useful are the higher glycols, polyglycols, polyoxides, glycol ethers, propylene glycol ethers, . . . the like, or combinations thereof. Suitable commercially available biodegradable hydrotropic surfactants include dipropionates such as, but not limited to, MIRATAINE® H2C HA disodium lauriminodipropionate available from Rhodia Novecare (Cranbury, N.J.). Additional useful hydrotropes include the free acids, alkali metal salts of sulfonated alkylaryls such as alkylated diphenyloxide sulfonates, toluene, xylene, cumene and phenol or phenol ether sulfonates or alkoxylated diphenyl oxide disulfonates (DOWFAX® materials); alkyl and dialkyl naphthalene sulfonates, alkoxylated derivatives, . . . the like, or combinations thereof.

A number of commercially available hydrotropes may be suitable for use in aspects of embodiments and/or embodiments of the present invention. Commercially available hydrotropes may be obtained from a variety of vendors including, but not limited to, Mason Chemical Company (Arlington Heights, Ill.), and Nease Corporate (Cincinnati, Ohio. For example, suitable commercially available hydrotropes include, but are not limited to, NAXONATE® 4L sodium xylene sulfonate, NAXONATE® 4LS sodium xylene sulfonate, NAXONATE® 4LOF sodium xylene sulfonate, NAXONATE® SX sodium xylene sulfonate, NAXONATE® 4AX ammonium xylene sulfonate, NAXONATE® 40SC sodium cumene sulfonate, NAXONATE® 45SC sodium cumene sulfonate, NAXONATE® SC sodium cumene sulfonate, NAXONATE® 4ST sodium toluene sulfonate, NAXONATE® ST sodium toluene sulfonate, and NAXONATE® 4KT potassium toluene sulfonate available from Nease Corporate (Cincinnati, Ohio).

F. One or More Buffers

Aspects of embodiments and embodiments of the present invention relate to one or more buffers and cleaner concentrates and/or cleaners. An inclusion of one or more buffers that results in a pH other than that optimally sought for any given cleaner concentrates and/or cleaners may result in a reduction or limitation of the cleaners effect. For example, cleaners' ingredients may be sensitive to the pH in the surrounding environment. Accordingly, altering the pH of the aqueous environment to which the cleaners' ingredients are introduced regulates the ability of such ingredients to solublize a soil present on a surface.

As a result, the one or more buffers generally maintain the pH of the environment within which the cleaners' ingredients works to a pH of about 8 to about 14. To that end, in aspects cleaner concentrates have a pH of about 8 to about 14; in other aspects, a pH of about 10 to about 14; and in yet other aspects, a pH of about 12 to about 14.

Generally any one or more buffers that are capable of providing an environment of the proper pH can be used in the processing cleaner concentrates and/or cleaners of the present invention. When used, one or more buffers may include a base and a complementary acid. Examples of a base include, without limitation, one or more of a borate (e.g., tetraborate, borax, . . . the like, or combinations thereof), bicarbonate (e.g., sodium bicarbonate, mixtures of sodium bicarbonate and sodium carbonate, . . . the like, or combinations thereof), carbonate (e.g., sodium carbonate), phosphate (e.g., disodium phosphate, monosodium phosphate, mixtures of disodium phosphate and trisodium phosphate, . . . the like, or combinations thereof), . . . the like, or combinations thereof. Examples of complementary acids include, without limitation, one or more of an alkali metal salt of an acid, alkali metal salt of an organic acid, or organic amine salt of an organic acid, such as, without limitation, sodium, potassium or triethanolamine salts of acetic acid, boric acid, citric acid, dodecyl benzene sulfonic acid (DDBSA), lactic acid, tartaric acid, . . . the like, or combinations thereof.

Generally, if pH control is desired to insure a certain activity of cleaner concentrates' ingredients and/or cleaners' ingredients, an appropriate type and amount of one or more buffers may be used. As to an amount of one or more buffers, in one aspect it may be up to about 10 wt % or more, based on the total weight of the cleaner concentrate. In another aspect, the one or more buffers may be about 0.1 wt % to about 10 wt %, based on the total weight of the cleaner concentrate. In yet another aspect, the one or more buffers may be about 0.1 wt % to about 5 wt %, based on the total weight of the cleaner concentrate. In still yet another aspect, an amount of one or more buffers may be about 0.1 wt % to about 1 wt %, based on the total weight of the cleaner concentrate. One or more buffers suitable, due to their overall stability and compatibility with cleaner concentrates' ingredients and/or cleaners' ingredients include, without limitation, sodium bicarbonate, sodium citrate, and borax. Also, such one or more buffers are readily commercially available, for example sodium citrate from A.E. Staley Division (Decatur, Ill.) of Tate & Lyle PLC.

G. Other Additives

According to aspects of embodiments and embodiments of the present invention, cleaner concentrates and/or cleaners may contain one or more additives to provide a desired characteristic to the solution. Suitable additives include, but are not limited to, one or more dyes, pigments, perfumes, preservatives, antimicrobial agents, corrosion inhibitors, bleaching agents, bleach activators, abrasives, anti-redeposition agents, softeners, conditioners, . . . the like, or combinations thereof. In an aspect of one embodiment, the cleaner concentrates and/or cleaners comprise at least one dye to provide a desirable color.

Typically, additives, such as those mentioned above, are each individually present in an amount of less than about 2.0 wt %, based on a total weight of the cleaner concentrate. In aspects of embodiments, each additive, when present, is individually present in an amount ranging from about greater than zero (≧0) to about 0.5 wt %, based on a total weight of the cleaner concentrate.

A number of commercially available additives may be used in aspects of embodiments and/or embodiments of the present invention. Commercially available dyes suitable for use in the present invention include, but are not limited to, Yellow Dye FD&C#5 available from Pylam Products (Tempe, Ariz.); Blue Pylaklor LX 10092 available from Pylam Products (Tempe, Ariz.); Resorcine Brown 5GM available from Pylam Products (Tempe, Ariz.); and Acid Red #1 available from Keystone Aniline Corporation (Inman, S.C.). Commercially available perfumes suitable for use in the present invention include, but are not limited to, perfume SZ-6929 (Apple) available from J. E. Sozio, Inc. (Edison, N.J.); Orange SZ-40173 available from J. E. Sozio, Inc. (Edison, N.J.); and MF 3773 (lemon) available from Mane, USA (Wayne, N.J.).

II. Methods of Making the Cleaner Concentrate

The cleaner concentrate of the present invention may be prepared using conventional mixing techniques. The ingredients for forming the cleaner concentrate may be combined in any order at room temperature. Typically, cleaner concentrates are prepared by combining the ingredients while mixing: one or more solvents, one or more alkalinity sources, one or more chelants, one or more surfactants (when present), one or more buffers (when present), one or more hydrotropes (when present) and one or more other additives (e.g. when present, one or more dyes, pigments, perfumes, preservatives, antimicrobial agents, corrosion inhibitors, bleaching agents, bleach activators, abrasives, anti-redeposition agents, softeners, conditioners, or combinations thereof).

In one aspect of an embodiment, a cleaner concentrate is prepared using the following steps: (1) forming a premix by adding at least one solvent (e.g., water) to a mix tank equipped with a stirrer after making sure that the first mix tank is clean; (2) stirring the at least one solvent at a speed sufficient to form a vortex in the at least one solvent; (3) adding at least one or more alkalinity sources to the at least one solvent while mixing; (4) letting the mixture stir until the mixture is uniform; (5) forming a main mixture by adding one or more chelants and one or more surfactants to the mix tank; (6) when appropriate, adding to the main mixture in the mix tank one or more hydrotropes; (7) adding dye to the mix tank and mixing the mixture; and (8) sampling the mixture to test for desired mixture properties.

In a further desired embodiment of the present invention, a cleaner 12 is prepared using the following steps: (1) forming a premix by adding at least one solvent (e.g., water) to a mix tank equipped with a stirrer after making sure that the first mix tank is clean; (2) stirring the at least one solvent at a speed sufficient to form a vortex in the at least one solvent; (3) adding at least one or more alkalinity sources (e.g., one or more of 2-Amino-2-methyl-1-propanol, NaOH, or monoethanolamine) to the at least one solvent while mixing; (4) letting the mixture stir until the mixture is uniform; (5) forming a main mixture by adding one or more chelants (e.g., one or more of HEIDA 28% chelant, TRILON® M 40% chelant, or ACUSOL® 445N chelant) and one or more surfactants (e.g., one or more of GENAPOL® UD 070 surfactant, SURFONIC® L12-6 surfactant, DDBSA MIRANOL® HMA surfactant, POLYSTEP® B29 surfactant, or BARLOX® 12 surfactant) to the mix tank; (6) when appropriate, adding to the main mixture in the mix tank one or more hydrotropes (e.g., one or more of STEPANATE® SXS hydrotrope, MIRATAINE® H2C HA 30% hydrotrope, or PG {propylene glycol}) hydrotrope); (7) adding dye to the mix tank and mixing the mixture for about 15 minutes; and (8) sampling the mixture to test for desired mixture properties.

III. Methods of Using the Cleaner Concentrate

The compositions of the present invention may be manufactured as either cleaner concentrates or cleaners (e.g., diluted aqueous cleaner concentrates). Typically formulations are prepared initially in concentrated form by combining the ingredients in a mixing vessel and mixing the ingredients creating a homogeneous liquid composition.

The resulting concentrate may be diluted and bottled for purposes for cleaning For example, the cleaner concentrate may be sold as such for institutional and commercial settings that use a significant amount and/or type of the cleaner. The purchased cleaner concentrate then may be diluted to the desired strength to create one or more appropriate cleaners at the site where they will be used. Systems for diluting cleaner concentrates are known in the art and are normally employed by a wide variety of users, e.g. hotels, hospitals, restaurants, etc. Dispensing systems may cover a wide range in terms of complexity. The method of dilution may be rather simple and manual or require operator experience. A method for dispensing a concentrate is described in U.S. Pat. No. 5,033,649 that is incorporated herein by reference. The solution storage and dispensing apparatus has a container with two inlet ports for two different types of liquid e.g., a water and the liquid cleaning concentrate. The inlet ports for the two different types of liquid accommodate two inlet lines which transport the liquid into the container. The inlet lines are each removably interconnected to their respective liquid sources and container inlet ports. The container has a suitable proportioning means, such as an aspirator, permanently mounted inside of it.

Another method for dispensing a concentrate is described in U.S. Pat. No. 5,832,972 with examples of cooperating bottles illustrated in U.S. Pat. No. D385,494; U.S. Pat. No. D385,496; U.S. Pat. No. D385,799; and U.S. Pat. No. D387,285. Thus when the cleaner concentrate is used to make more than one cleaner, a suitable proportioning means outlet of a dispensing system may be configured with multiple outlet ports such that each port is designated for dispensing cleaner concentrate diluted by a predetermined amount to provide a cleaner for a corresponding predetermined soil removal application. In turn the dispensing system may include a plurality of bottles. Alternatively, the dispensing system may include a plurality of dispensing apparatus. Each of the dispensing apparatus may include a housing having an inner cavity and an exit aperture, a dispensing mechanism positioned in the housing and a lock-out member operatively connected to the exit aperture, with the outlet member having an opening. Each of the plurality of bottles may have a neck having a different geometric cross-sectional configuration. Each of the plurality of lock-out members may have a cross-sectional geometric configuration which matches the geometric configuration of the respective bottles, wherein necks of bottles have different configurations can not enter the exit. In this manner an appropriate cleaner comprising the suitable amount of cleaner concentration may be dispensed into a bottle designated for a predetermined soil removal application.

A. Soil Sources

Aspects of embodiments of the present invention relate to the soils to be removed and the sources of such soils. New low trans-fat cooking fats and/or oils (sometimes referred to as zero grams trans-fat cooking fats and/or oils) have been introduced. Examples of such oils for use in food service frying and food processor frying are presented in the Table 1. Analogous products have been introduced for shortenings and margarines. Low linolenic soybean (soya) oil is included among these types of alternatives. It will be appreciated that in use, the compositions of these alternative types of oils may change, for example due to, among other things, an introduction of fats from the foods being processed; an evaporation of the higher vapor pressure components, an oxidation of the trans-fats (monoglycerides) as well as unsaturated diglycerides and/or unsaturated triglycerides; a polymerization (e.g., cross linking) of the trans-fats (monoglycerides) as well as unsaturated diglycerides, and/or unsaturated triglycerides; or combinations thereof. When spilled, splattered, or aspirated on a surface, similar changes, including polymerization, may occur thereby creating tenacious soils for example on processing equipment surfaces, processing area floor, walls, and/or ceilings. Likewise, evaporated higher vapor pressure components may coat a surface and then undergo such changes, including polymerization, again creating tenacious soils. Also in these instances temperature, moisture, light, and reactive species of other sources or in the atmosphere may also interact with these spills, splatters, and/or deposited vapors, to result in polymerization. In some instances such soil can resemble lacquers. Surprisingly, cleaners made using the cleaner concentrates according to aspects of embodiments of the present invention are capable of removing such tenacious soils.

One way of classifying these alternative types of oils may be according to their composition based on an Iodine Value (IV). That is the number of grams of iodine required to saturate the double bonds of 100 g of oil. To that end, these alternative types of oils may fall in the following categories:

drying oils: IV>140;

semi-drying oils: IV=124-140; and non-drying oils: IV<125.

The Iodine Value (IV) may be calculated, using the formula:

$$IV=\{3.04(\text{wt \% linolenic acid})+2.02(\text{wt \% linoleic acid})+(\text{wt \% oleic acid})\}/1.16.$$

As shown in Table 1, the calculated iodine value (IV) for these alternative types of oils ranges from about 38 to about 132 where at an upper end in a starting or undegraded form (e.g., Low Linolenic Soya has a calculated IV of about 121 while Soya has a calculated IV of about 132) these oils may be classified as semi-drying oils. Some commercially available alternative types of oils have a calculated iodine value (IV) ranging from about 53 to about 126 in a starting or undegraded form that can change to from about 47 to about 124 in a spent or degraded form.

about 0 wt % to about 39 wt % based on the total weight of the cleaner concentrate. The water may be the remainder of the cleaner concentrate 100 wt % of water based on the total weight of the cleaner concentrate.

TABLE 1

| Type of Alternative | | C12 (lauric acid) | C14 (myristic acid) | C16 (palmitic acid) | C18 (stearic acid) | Total Saturated Fatty Acids | C18:1 (oleic acid) | C18:2 (linoleic acid) | C18:3 (linolenic acid) | Total Trans Fatty Acids‡ | Iodine Value (IV) |
|---|---|---|---|---|---|---|---|---|---|---|---|
| Min. | | 0.10 | 0.10 | 3.40 | 1.90 | 7.40 | 6.20 | 1.60 | 0.20 | 7.80 | 38 |
| Max. | | 47.50 | 18.10 | 44.00 | 15.90 | 91.60 | 81.30 | 60.70 | 9.70 | 90.30 | 132 |
| General Vegetable (Veg) Oils | Soya | — | 0.10 | 10.80 | 4.00 | 14.90 | 23.80 | 53.30 | 7.10 | 84.20 | 132 |
| | Canola | — | 0.10 | 4.40 | 1.90 | 7.80 | 57.60 | 21.20 | 9.70 | 88.50 | 112 |
| | Cottonseed | — | 0.80 | 23.90 | 2.40 | 27.10 | 17.40 | 53.40 | 0.20 | 71.00 | 109 |
| | Corn | — | — | 11.40 | 1.90 | 13.30 | 25.30 | 60.70 | — | 86.00 | — |
| Medium Frying Stability Vegetable (Veg) Oils | High Oleic Canola | — | 0.10 | 3.40 | 2.50 | 7.40 | 76.80 | 7.80 | 2.60 | 87.20 | 87 |
| | Low Linolenic Soya | — | — | 9.00 | 5.00 | 14.00 | 30.00 | 50.00 | 3.00 | 83.00 | 121 |
| | Mid Oleic Sunflower | — | — | 5.00 | 4.00 | 9.00 | 60.00 | 30.00 | — | 90.00 | — |
| | High Oleic Sunflower | — | — | 3.70 | 5.40 | 9.10 | 81.30 | 9.00 | — | 90.30 | — |
| High Frying Stability Vegetable Oils | Palm Oil | 0.20 | 1.10 | 44.00 | 4.50 | 49.80 | 39.20 | 10.10 | — | 49.30 | — |
| | Palm Olein | 0.20 | 1.00 | 39.80 | 4.40 | 45.40 | 42.50 | 11.20 | — | 53.70 | — |
| | Coconut | 47.50 | 18.10 | 8.80 | 2.60 | 91.60 | 6.20 | 1.60 | — | 7.80 | — |
| Animal fats | Beef Tallow | 0.10 | 4.40 | 25.10 | 15.90 | 48.00 | 39.20 | 2.20 | 0.20 | 41.60 | 38 |
| | Lard | 0.10 | 1.30 | 23.10 | 13.30 | 38.60 | 42.20 | 12.20 | 1.40 | 55.80 | 61 |
| Blending Soft Oils | General Vegetable Oils/High Stability Vegetable Oils | — | 0.1 | 3.9 | 2.2 | 7.6 | 67.2 | 14.5 | 6.2 | 87.90 | 99 |
| Blending Oils for Solids, Performance, or to Reduce Cost | Palm Oil + General Vegetable Oils/High Stability Vegetable Oils | 0.1 | 0.6 | 24.2 | 3.2 | 28.8 | 48.4 | 15.7 | 4.9 | 69.00 | 82 |

‡Unsaturated Fatty Acids

B. Using Cleaner Generally

Aspects of embodiments of the present invention relate to methods for removing from a surface, soils originating from a fat and/or oil comprising one of a low trans-fat fat or oil or a non-trans-fat fat or oil and, optionally, fats from food processing. Such method may generally involve, when not already done, formulating a cleaner; communicating the cleaner with the soiled surface; and removing any residue from the surface thereby cleaning the surface. As to the formulating a cleaner, a sufficient amount of cleaner concentrate may be combined with water. The cleaner is communicated with the soiled surface for at least a sufficient amount of time to allow the cleaner to interact with the soil of the soiled surface. Then, any residue may be removed from the surface thereby cleaning the surface.

As noted, such a cleaner concentrate may include one or more alkalinity sources, one or more chelants, one or more surfactants, and the remainder water. The one or more alkalinity sources may be present in an amount sufficient to provide a free alkalinity (expressed as $Na_2O$) of greater than about 3.6 wt %, based on the total weight of the cleaner concentrate, and a total alkalinity (expressed as expressed as $Na_2O$) of greater than about 6.1 wt %, based on the total weight of the cleaner concentrate. The one or more chelants may be present in an amount sufficient to permit a use of a water having a hardness number up to about 600 ppm (600 mg/L) or more. The one or more surfactants may range from In an aspect, the formulating involves combining a sufficient amount of cleaner concentrate with water so as to be capable of removing a soil resulting from a one of a low trans-fat fat or oil or a non-trans-fat fat or oil of one or more oils having an iodine value from about 38 to about 132 calculated, using the formula:

$$IV=\{3.04(\text{wt \% linolenic acid})+2.02(\text{wt \% linoleic acid})+(\text{wt \% oleic acid})\}/1.16.$$

In some instances, a soil resulting from the one of a low trans-fat fat or oil or a non-trans-fat fat or oil may include one or more triglycerides. In other instances, such triglycerides may be polymerized. In some instances, cleaners according to aspects and/or embodiments of the present inventions may be "self-working" not having a need for manual scrubbing.

C. Using Cleaner on Floors

Surprisingly, in one aspect in formulating a cleaner, combining at least about 0.05 ounces of cleaner concentrate with water to make about 1 gallon of cleaner may be sufficient to be capable of cleaning the soil from a floor. In another aspect, combining from about 0.05 to about 12.8 ounces of cleaner concentrate with water to make about 1 gallon of cleaner may be sufficient to be capable of cleaning the soil from a floor. In yet another aspect, combining from about 0.05 to about 4 ounces of cleaner concentrate with water to make about 1 gallon of cleaner may be sufficient to be capable of cleaning the soil from a floor. In still yet another aspect, the combining from about 0.1 to about 8 ounces of cleaner concentrate with water to make about 1 gallon of cleaner may be sufficient to be capable of cleaning a soil from a quarry tile. In a still further aspect, combining from about 0.25 to about 4 ounces of cleaner concentrate with water to make about 1 gallon of cleaner may be sufficient to be capable of cleaning a soil from a quarry tile.

D. Using Cleaner on Other Surfaces

Also surprising, in one aspect in formulating a cleaner, combining at least about 0.05 ounces of cleaner concentrate with about 9 ounces of water (i.e., cleaner concentrate:water volume ratio=at least about 1:180) may be sufficient to be capable of cleaning the soil from a surface of a type 304 stainless steel tile. In another aspect, combining from about 0.18 to about 9 ounces of cleaner concentrate with about 9 ounces of water (i.e., cleaner concentrate:water volume ratio=from about 1:50 to about 1:1) may be sufficient to be capable of cleaning the soil from a surface of a type 304 stainless steel tile. In yet another aspect, combining about 0.45 to about 2.25 ounces of cleaner concentrate with about 9 ounces of water (i.e., cleaner concentrate:water volume ratio=from about 1:20 to about 1:4) may be sufficient to be capable of cleaning the soil from a surface of a type 304 stainless steel tile.

To that end, cleaning systems 10 of the present invention may be used in a variety of applications including, but not limited to, household, commercial, institutional, and industrial applications. Suitable uses include, but are not limited to, cleaners for floors, cooking surfaces and cookware, such as grill surfaces, toasters, fryers, ovens, hoods, rotisseries, and popcorn poppers, such as those commonly found in the restaurant industry.

IV. Examples

In the following examples, a variety of test and/or methods were used to characterize cleaner concentrates and/or the cleaners made using such cleaner concentrates. Among these were:

Free Alkalinity (expressible as wt % $Na_2O$) and Total Alkalinity (expressible as wt % $Na_2O$) determination;

Stability determination; and

Soil Removal determination.

Alkalinity Determination

Free alkalinity and total alkalinity, based on the total weight of the solution is determined as follows:

Sample Preparation: Liquid samples are diluted to prepare a 1 wt % solution of the product diluted to volume with deionized water (DI-water). Liquid samples are mixed thoroughly. Typically, an about 10 g sample is diluted to 1 L using DI water.

Procedure: Manual Titration Method

1. A 10 mL aliquot of the sample solution is pipetted into a 250 mL beaker and 90 mL of DI-water are added.
2. Using a pH meter and magnetic stirrer, titration is carried out with 0.1N hydrochloric acid. When using a pH meter, the endpoint is determined after the pH is reached and holds steadily at the desired pH for at least about 30 seconds.

Calculations: 1. Calculations to report the measured wt % activity of free alkalinity (expressed as wt % $Na_2O$) and wt % total alkalinity (expressed as wt % $Na_2O$) are shown below:

wt % Active Alkalinity (as $Na_2O$):

$$\text{wt \% Alkalinity as } Na_2O = \frac{(\text{mL HCl to pH 8.3})(\text{N HCl})(31)(100)}{(\text{g sample titrated})(1000)}$$

wt % Total Alkalinity (as $Na_2O$):

$$\text{wt \% Alkalinity as } Na_2O = \frac{(\text{mL HCl to pH 4.0})(\text{N HCl})(31)(100)}{(\text{g sample titrated})(1000)}$$

Stability Determination

A cleaner concentrate's and/or a cleaner's stability is determined as follows:

Sample Preparation: Samples of a product (e.g., cleaner concentrate or cleaner) are obtained. Two to three ounces (2-3 oz.) of the product are transferred to, for example, six on more sample containers. The samples are used for evaluating product stability as follows:

at least one sample for cold temperature (40° F.);

at least one sample for ambient temperature (about 68° F. to 77° F.);

at least one sample for elevated temperature (120° F.);

at least one sample for cycling through temperature zones (120° F. to Ambient); and at least one sample for cycling through temperature zones (0° F. to 40° F. to Ambient).

at least one sample for cycling through temperature zones (40° F. to Ambient).

Procedure: Cold, Ambient, and Elevated Temperature

Each sample exposed to the cold, ambient, and elevated temperatures is examined for any changes (e.g., dye fade, flocculation, crystallization, . . . the like, or combinations thereof) after 24, 48, and 72 hours and at least weekly, and as frequently as daily, for up to a total of 6 weeks exposure. The cold temperature samples are maintained in a refrigerator set at 40° F. The ambient temperature samples are maintained at a room temperature, about 68° F. to 77° F. The elevated temperature samples are maintained in an oven set at 120° F. Any samples that experience freezing/thawing during cycling are allowed to thaw completely in the refrigerator before evaluation.

Procedure: Cycling Through Temperature Zones

One cycling routine is 120° F. to Ambient, another is 0° F. to 40° F. to Ambient, while yet another is 40° F. to Ambient. The 120° F. to Ambient cycling routine involves holding a sample in an oven set at 120° F. on a first day, then holding the sample at ambient temperature the following day, and repeating the cycle at least two more times while examining the sample at each stage for any changes (e.g., dye fade, flocculation, crystallization, . . . the like, or combinations thereof). The 0° F. to 40° F. to Ambient cycling routine involves holding a sample in a freezer set at 0° F. on a first day, holding the sample in refrigerator set at 40° F. on a second day, holding the sample at ambient temperature and repeating the cycle throughout the 6 week test period while examining for any changes (e.g., dye fade, flocculation, crystallization, . . . the like, or combinations thereof). The 40° F. to Ambient cycling routine involves holding a sample in a refrigerator set at 40° F. on a first day, holding the sample at ambient temperature and repeating the cycle throughout the 6 week test period while examining for any changes (e.g., dye fade, flocculation, crystallization, . . . the like, or combinations thereof). The cold temperature samples are maintained in a refrigerator set at 40° F. The ambient temperature samples are maintained at a room temperature, about 68° F. to 77° F. The elevated temperature samples are maintained in an oven set at 120° F. Any samples that experience freezing/thawing during cycling are allowed to thaw completely in the refrigerator before evaluation.

Soil Removal Determination.

Evaluating a cleaner concentrate's and/or a cleaner's ability to remove a soil involves preparing substrates with a test soil as described below. Then, a candidate cleaner concentrate or cleaner is applied to a substrate having an appropriately prepared test soil to evaluate the "self-working" (without manual scrubbing) ability of the cleaner concentrate or a cleaner to remove the test soil. Details of the procedures follow:

Test Substrate Preparation: Test substrates include: quarry tile (unglazed) measuring about 4 inches by 8 inches by 0.5 inch thick, commercially available from American Olean Corporation (Dallas, Tex.) and stainless steel (grade 304) measuring 3 inches by about 6 inches by 1/16 inch thick, commercially available from Q-Lab Corporation (Cleveland, Ohio).

Soiling: Quarry Tile

1. About 0.2 grams of spent shortening (in the present examples resulting from a low linolenic soya frying oil, see e.g., Table 1, after commercial use) are spread over one surface (measuring about 4 inches by 8 inches) of a quarry tile.
2. The coated surface is sprayed until saturated with water having an about 500 ppm hardness using a spray bottle. (500 ppm hardness water recipe: Add 50 mL of standard hardness solution {e.g., 2:1 Ca:Mg; 9.78 g $CaCl_2$ $2H_20$/L; and 6.76 g $MgCl_2$ $6H_20$/L} is added to 950 mL tap water)
3. The coated quarry tile is placed into an oven set at about 120° F. and held for about 24 hours.
4. The heat-treated quarry tile is removed and allowed to cool for about one (1) hour.
5. The cooled quarry tile is rinsed under cold water and the coated surface of the heat-treated quarry tile is lightly rubbed using a gloved hand to remove any loose material.
6. Steps 1-4 are repeated until the surface is uniformly coated (3-4 total applications) with a test soil.
7. The uniformly coated quarry tile is allowed to air dry for a minimum of 12 hours before use in evaluating a cleaner concentrate's or a cleaner's ability to remove the test soil.

Soiling: Stainless Steel Tile

1. About 0.05 grams of spent shortening (in the present examples resulting from a low linolenic soya frying oil, see e.g., Table 1, after commercial use) are spread over one surface of a stainless steel tile (measuring about 3 inches by 6 inches).
2. The coated stainless steel or glass tile is placed into an oven set at about 120° F. and held for three days.
3. The uniformly stainless steel or glass tile is allowed to air dry for a minimum of 12 hours before use in evaluating a cleaner concentrate's or a cleaner's ability to remove the test soil.

Examples 1-7 and Comparative Example

Several exemplary cleaner concentrates were prepared by mixing the ingredients identified in Table 2. In Table 2, the amounts of ingredients are provided in wt % (weight percent). These exemplary cleaner concentrates were used to make a plurality of cleaners by mixing with water having an about 500 ppm (500 mg/L) in the amount shown in the Table 2. These cleaners were then tested for their ability to remove tests soils from coated quarry tile prepared according to the procedure described above using commercially available alternative types of oils having a calculated iodine value (IV) ranging from about 53 to about 126 in a starting or undegraded form that changed to from about 47 to about 124 in a spent or degraded form (i.e., after commercial use).

Surprisingly, the cleaner concentrates and the cleaners made according to aspect of embodiments and embodiments of the present invention performed better than those cleaners made using the comparative cleaning concentrate in each instance.

Cleaner concentrates of Example 6 and further cleaner concentrates made substantially according to the formula of Example 6 were characterized. Such cleaner concentrates were found to have a pH value ranging from about 13.1 to about 13.4; refractive index ranging from about 30 to about 33; a free alkalinity (expressed as $Na_2O$) ranging from about 7.2 to about 8.0; a total alkalinity (expressed as $Na_2O$) ranging from about 8.0 to about 8.8; a specific gravity of ranging from about 1.13 to about 1.14; and acceptable cold stability (40° F.), ambient stability (about 68° F. to 77° F.), elevated stability (about 120° F.), 120° F. to ambient stability, 40° F. to ambient stability, and 0° F. to 40° F. to ambient stability.

TABLE 2

| Raw Material | Example 1 Percent | Example 2 Percent | Example 3 Percent | Example 4 Percent | Example 5 Percent | Example 6 Percent | Example 7 Percent | Comparative Percent |
|---|---|---|---|---|---|---|---|---|
| Water | — | 47.62 | 40.00 | 40.00 | 15.34 | 40.72 | 31.00 | 36.64 |
| TOTAL WATER | 53.55 | 75.36 | 74.27 | 72.73 | 62.73 | 72.34 | 63.24 | 59.59 |
| AMP-95 ® (95% 2-Amino-2-methyl-1-propanol + 5% water) | 9.47 | — | — | — | — | — | — | 3.00 |
| NaOH 50%(50% NaOH + 50% water) | 28.40 | 7.14 | 6.00 | 13.00 | 40.00 | 13.00 | 18.00 | 3.40 |
| MEA (monoethanolamine) | — | — | 4.00 | 4.00 | — | 4.00 | — | — |
| TOTAL ALKALINITY | 23.19 | 3.57 | 6.96 | 10.46 | 20.00 | 10.46 | 9.00 | 4.55 |
| HEIDA 28% (28% 2-hydroxyethyliminodiacetic acid, disodium salt + 72% water) | 31.55 | — | 30.00 | 23.00 | 22.92 | 22.00 | — | — |
| TRILON ® M 40% (40% methylglycinediacetic acid, trisodium salt + 60% water) | — | 23.81 | — | — | — | — | 18.00 | 20.00 |
| ACUSOL ® 445N (45% polyacrylic acid, Na salt | — | — | — | — | 10.02 | — | — | — |

TABLE 2-continued

| Raw Material | Example 1 Percent | Example 2 Percent | Example 3 Percent | Example 4 Percent | Example 5 Percent | Example 6 Percent | Example 7 Percent | Comparative Percent |
|---|---|---|---|---|---|---|---|---|
| homopolymer + 55% water) | | | | | | | | |
| TOTAL CHELANT | 8.83 | 9.52 | 8.40 | 6.44 | 10.93 | 6.16 | 7.20 | 8.00 |
| GENAPOL ® UD 070 C11-oxo-alcohol polyglycol ether (7 EO) | 2.76 | — | — | — | — | — | — | — |
| SURFONIC ® L12-6 lauryl alcohol ethoxylates | — | 4.76 | 4.50 | 4.50 | — | 4.50 | 5.00 | 4.00 |
| dodecylbenzene sulfonic acid (DDBSA) | 4.73 | — | — | — | — | — | — | 6.00 |
| MIRANOL ® HMA (40% sodium lauroamphoacetate + 60% water) | — | 4.76 | 2.63 | 2.63 | — | 7.50 | 5.00 | 4.00 |
| POLYSTEP ® B29 (32% sodium octyl sulfate + 68% water) | — | — | 7.50 | 7.50 | — | 2.63 | — | — |
| BARLOX ® 12 (30% cocamidopropyl amine oxide + 70% water) | — | — | — | — | 2.48 | — | — | — |
| TOTAL SURFACTANT | 7.49 | 6.67 | 7.95 | 7.95 | 0.74 | 8.34 | 7.00 | 11.60 |
| MIRATAINE ® H2C HA 30% (30% sodium laurimino dipropionate + 70% water) | 23.10 | — | — | — | 5.20 | — | — | — |
| STEPANATE ® SXS (41% sodium xylenesulfonate + 59% water) | — | 11.90 | 5.00 | 5.00 | — | 5.00 | 16.00 | 11.00 |
| PG (propylene glycol) | — | — | — | — | 4.00 | — | 2.00 | 8.75 |
| TOTAL HYDROTROPE | 6.93 | 4.88 | 2.05 | 2.05 | 5.56 | 2.05 | 8.56 | 13.26 |
| Sodium bicarbonate | — | — | — | — | — | — | — | — |
| Sodium citrate | — | — | 0.38 | 0.38 | — | 0.38 | 5.00 | 0.00 |
| Boric acid | — | — | — | — | — | — | — | 3.00 |
| TOTAL BUFFER | 0.00 | 0.00 | 0.38 | 0.38 | 0.00 | 0.38 | 5.00 | 3.00 |
| Green dye LX | — | — | — | — | — | — | — | — |
| FD&C Yellow #5 | — | — | — | — | — | 0.01 | — | — |
| Fragrance | — | — | — | — | 0.04 | 0.26 | — | — |
| TOTAL AESTHETICS | 0.00 | 0.00 | 0.00 | 0.00 | 0.04 | 0.27 | 0.00 | 0.00 |

Further, testing of cleaners made using the cleaner concentrates made substantially according to the formula of Example 6 and the Comparative Example was performed. In particular, cleaners were made by mixing with water having an about 500 ppm (500 mg/L) to make a 2 ounces of cleaner concentrate in one (1) gallon of cleaner (2 ounces/gallon); a 4 ounces of cleaner concentrate in one (1) gallon of cleaner (4 ounces/gallon); and a 6 ounces of cleaner concentrate in one (1) gallon of cleaner (6 ounces/gallon). In each instance, the cleaners made using the cleaner concentrates made substantially according to the formula of Example 6 exhibited a soil removal rating of 3+ whereas the cleaners made substantially according to the formula of the Comparative Example exhibited a soil removal rating of 2. In interpreting these data, it should be understood that the soil removal rating is graded on a scale from 1 to 4, where a rating of:

1 is given for a cleaner that removes up to about 25 percent of the test soil from the test substrate under "self-working" (without manual scrubbing) conditions;

2 is given for a cleaner that removes greater than about 25 percent and up to about 50 percent of the test soil from the test substrate under "self-working" (without manual scrubbing) conditions;

3 is given for a cleaner that removes greater than about 50 percent and up to about 75 percent of the test soil from the test substrate under "self-working" (without manual scrubbing) conditions; and 4 is given for a cleaner that removes greater than about 75 percent and up to 100 percent of the test soil from the test substrate under "self-working" (without manual scrubbing) conditions.

The cleaner concentrate of Example 6 was field tested against commercially available cleaners in facilities that used a low-linolenic soybean oil option (e.g., such as any one of Advantage LL brand soy oil processed by Cargill; VISTIVE low-linolenic soy oil processed by Ag Processing, CHS and Zeeland Farms; TREUS™ brand soy oil, developed in partnership by Bunge and DuPont; and Asoyia ultra low-linolenic soybean oil). Surprisingly, in facilities having hard water sources the cleaners made using the cleaner concentrate in an amount ranging from about 0.75 ounces/gallon to about 8 ounces/gallon were able to clean floors thus removing a tack and/or stick sensation after cleaning In contrast commercially available cleaners used according to label instructions using the same hard water were unable to remove the tacky and/or sticky sensation.

Other than in the operating examples, or where otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by an aspect of an embodiment and/or embodiments of the present invention. At the very least, and not as an attempt to limit the application of the doctrine of equivalents to the scope of the claims, each numerical parameter should be construed in light of the number of significant digits and ordinary rounding approaches.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

While typical aspects of embodiment and/or embodiments have been set forth for the purpose of illustration, the foregoing description and the accompanying drawings should not be deemed to be a limitation on the scope of the invention. Accordingly, various modifications, adaptations, and alternatives may occur to one skilled in the art without departing from the spirit and scope of the present invention. It should be understood that all such modifications and improvements have been deleted herein for the sake of conciseness and readability but are properly within the scope of the following claims.

The invention claimed is:

1. A cleaner concentrate comprising:

a) one or more alkalinity sources selected from the group consisting of alkanolamines, alkali metal hydroxides, alkali metal carbonates, and alkali metal silicates present in an amount of about 3.0 wt % or greater based on the total weight of the cleaner concentrate;

b) disodium ethanoldiglycine present in an amount of at least about 6 wt % sufficient to permit a use of a water having a hardness number up to about 600 ppm (600 mg/L) and to maintain the concentrate in a single phase;

c) from about 4 wt % to about 15 wt % a surfactant system comprising an alkyl sulfate, alcohol ethoxylate, and an alkyl amphoacetate mixture; and d) the remainder to 100 wt % of water, based on the total weight of the cleaner concentrate.

2. The cleaner concentrate according to claim 1, further comprising one or more buffers in an amount sufficient to substantially maintain a pH in range from about 8 to 14, or from about 0 wt % to about 9 wt % of one or more hydrotropes, or one or more buffers in an amount sufficient to substantially maintain a pH in range from about 8 to 14 and from about 0 wt % to about 9 wt % of one or more hydrotropes.

3. The cleaner concentrate according to claim 2, wherein the one or more buffers comprise one or more of a borate, bicarbonate, carbonate, phosphate, an alkali metal salt of an acid, alkali metal salt of an organic acid, or organic amine salt of an organic acid.

4. The cleaner concentrate according to claim 2, wherein the one or more buffers comprises about 0.1 wt % to about 10 wt %, based on the total weight of the cleaner concentrate.

5. The cleaner concentrate according to claim 4, wherein the one or more buffers comprises about 0.1 wt % to about 5 wt %, based on the total weight of the cleaner concentrate.

6. The cleaner concentrate according to claim 2, wherein the one or more hydrotropes comprise one or more of xylenesulfonic acid, sodium salt; toluenesulfonic acid, sodium salt; xylenesulfonic acid, ammonium salt; cumenesulfonic acid, sodium salt; cumenesulfonic acid, ammonium salt; xylenesulfonic acid, calcium salt; xylenesulfonic acid, potassium salt; or toluenesulfonic acid, potassium salt.

7. The cleaner concentrate according to claim 2, wherein the one or more hydrotropes comprise one or more of a higher glycol, polyglycol, polyoxide, glycol ether, propylene glycol ether, or diproprionate.

8. The cleaner concentrate according to claim 1, wherein the sources of alkalinity are present in an amount up to about 24 wt %.

9. The cleaner concentrate according to claim 1, wherein the sources of alkalinity are present in an amount up to about 18 wt %.

10. The cleaner concentrate according to claim 1, wherein the sources of alkalinity are present in an amount up to about 12 wt %.

11. A method for removing one or more soils from a surface comprising the steps of:

A) formulating a cleaner from a sufficient amount of cleaner concentrate and water, the cleaner concentrate comprising:

i) one or more alkalinity sources selected from the group consisting of alkanolamines, alkali metal hydroxides, alkali metal carbonates, and alkali metal silicates present in an amount of about 3.0 wt % or greater based on the total weight of the cleaner concentrate;

ii) disodium ethanoldiglycine present in an amount of at least about 6 wt % sufficient to permit a use of a water having a hardness number up to about 600 ppm (600 mg/L) and to maintain the concentrate in a single phase;

iii) from about 4 wt % to about 15 wt % a surfactant system comprising an alkyl sulfate, alcohol ethoxylate, and an alkyl amphoacetate mixture;

iv) the remainder to 100 wt % of water, based on the total weight of the cleaner concentrate; and B) communicating the cleaner with the soiled surface for at least a sufficient amount of time to allow the cleaner to interact with the soil of the soiled surface; and C) removing any residue from the surface thereby cleaning of the surface.

12. The method of claim 11, wherein the soil of the soiled surface comprises:

one or more soils originate from a fat and/or oil comprising one of a low trans-fat fat or oil or a non-trans-fat fat or oil having an iodine value from about 38 to about 132 calculated, using the formula:

$$IV=\{3.04(\text{wt \% linolenic acid})+2.02(\text{wt \% linoleic acid})+(\text{wt \% oleic acid})\}/1.16.$$

13. The method according to claim 12, wherein the low trans-fat fat or oil or the non-trans-fat fat or oil comprises one or more triglycerides.

14. The method according to claim 13, wherein the triglycerides are polymerized.

15. The method according to claim 11, wherein the formulating comprises combining at least about 0.05 ounces of cleaner concentrate with water to make about 1 gallon of cleaner.

16. The method according to claim 11, wherein the formulating comprises combining at least about 0.05 ounces of cleaner concentrate with water to make about 1 gallon of cleaner so as to be capable of cleaning the soil from a food service industry surface.

17. The method according to claim 16, wherein the food service industry surface is comprised of quarry tile or stainless steel.

* * * * *